US005090911A

United States Patent [19]

Welsh

[11] Patent Number: 5,090,911

[45] Date of Patent: Feb. 25, 1992

[54] MODULAR CONNECTOR SYSTEM

[75] Inventor: David E. Welsh, Tustin, Calif.

[73] Assignee: ITT Corporation, New York, N.Y.

[21] Appl. No.: 652,363

[22] Filed: Feb. 7, 1991

Related U.S. Application Data

[63] Continuation of Ser. No. 463,586, Jan. 11, 1990, abandoned.

[51] Int. Cl.[5] ..... H01R 23/70

[52] U.S. Cl. ..... 439/79; 439/248

[58] Field of Search ..... 439/59, 62, 65, 79, 439/247, 248, 252, 629, 632, 634, 637, 891, 908; 29/884

[56] References Cited

U.S. PATENT DOCUMENTS

| | | | |
|---|---|---|---|
| 4,380,119 | 4/1983 | Normann et al. | 29/884 |
| 4,418,972 | 12/1983 | Benasutti | 439/79 |
| 4,639,056 | 1/1987 | Lindeman et al. | 439/61 |
| 4,693,528 | 9/1987 | Asick et al. | 439/83 |
| 4,697,864 | 10/1987 | Hayes et al. | 439/444 |
| 4,715,829 | 12/1987 | Preputnick | 439/62 |
| 4,734,042 | 3/1988 | Martens et al. | 439/62 |
| 4,762,500 | 8/1988 | Dola et al. | 439/79 |
| 4,776,804 | 10/1988 | Johnson et al. | 439/79 |
| 4,806,110 | 2/1989 | Lindeman | 439/108 |
| 4,808,115 | 2/1989 | Norton et al. | 439/79 |
| 4,812,129 | 3/1989 | Rofer et al. | 439/891 |
| 4,812,133 | 3/1989 | Fleak et al. | 439/28 |
| 4,887,353 | 12/1989 | Preputnick | 439/79 |
| 4,909,748 | 3/1990 | Kozono et al. | 439/248 |
| 4,913,678 | 4/1990 | Avellino et al. | 439/874 |
| 4,920,642 | 5/1990 | Yanai et al. | 439/874 |
| 4,996,766 | 3/1991 | Piorunneck | 29/884 |

FOREIGN PATENT DOCUMENTS 3233652 3/1984 Fed. Rep. of Germany ..... 439/851

*Primary Examiner*—Gary F. Paumen

*Attorney, Agent, or Firm*—Thomas L. Peterson

[57] ABSTRACT

A connector is described, which has several rows of contacts connected to two rows of leads that engage terminals on a circuit board assembly, which enables a large number of contacts to be located in a connector of moderate cost. A connector insert comprises a wafer device (44, FIG. 3) and multiple leads, the leads having front lead portions (50) connected to multiple rows of contacts (30) on the wafer device, middle lead portions (56) molded into the wafer device, and rearward lead portions (52) lying in two parallel rows for contacting terminals on opposite sides of the circuit board assembly. Each wafer device includes two substantially identical wafers (74, 76, FIG. 6), to allow molding of a single row of leads at a time into a wafer. Each wafer has forwardly projecting towers (130, FIG. 5) that each lie around the front portion of a lead, and each contact has a periphery captured by a tower portion and a hole that receives a lead front portion. The contacts are arranged in columns on the wafer device, with at least four contacts in each column, and some of the lead middle portions extend both laterally and longitudinally to provide a small spacing or pitch of the lead rear portions. The insert has leaf springs (150, 152, FIG. 3) at opposite sides for centering the insert in the connector housing while allowing the insert to "float" within the housing.

4 Claims, 6 Drawing Sheets

MODULAR CONNECTOR SYSTEM

This is a continuation of application Ser. No. 463,586 filed Jan. 11, 1990, now abandoned.

BACKGROUND OF THE INVENTION

Aircraft and military electronic equipment is often designed to include circuit board assemblies or modules that are each formed of a plate-like metal heat sink sandwiched between a pair of circuit boards. The module is connected to a back plane or mother board through a connector system with one connector joined to an edge of the module. The connector has two rows of leads that contact two rows of terminals extending along the edges of the boards.

The connector usually must have a large number of contacts, such as more than 300, and yet the length of the connector is limited. Such a large number of contacts is accommodated by arranging them in multiple rows, such as in eight rows (i.e. four staggered rows). However, the leads extending from the contacts to the circuit boards, must lie in two parallel rows, with the leads closely spaced along the rows, such as at a spacing or pitch of 25 mil (one mil equals 0.001 inch). A reliable connector having multiple leads that extend from the multiple rows of contacts into two rows of lead rear portions, which can be constructed at moderate cost, would be of considerable value.

The plate-like heat sink can be thermally connected to a heat dissipator such as a metal cold plate, by clamping an edge of the heat sink thereto. Such clamping may displace the heat sink and module by a small but significant amount such as 10 mil. In order to avoid the need to transmit such sideward displacement through the connector to the mother board, it is desirable that an insert in the connector on which the contacts are mounted, be capable of slight lateral displacement without significant stress. A connector which enabled efficient "floating" of a connector insert would also be of considerable value.

In a connector wherein separate contacts must be attached to the front ends of leads that project from a layer of insulation formed by a wafer, it is desirable to mechanically hold each contact to the wafer in addition to its soldered or similar connection to the lead, to prevent stresses from being transmitted to the lead electrical connections. The wafer must hold the contacts precisely centered on the axes of the lead front portions, for all of a large number of such contacts. A connector which assured secure holding of each contact in a position precisely aligned with the projecting front end of each lead, would also be of considerable value.

SUMMARY OF THE INVENTION

In accordance with one embodiment of the present invention, a connector is provided, such as a type having leads with front portions connected to rows of contacts and rear portions that mate with a pair of rows of terminals of a circuit board assembly, which is of simple and reliable construction. The connector includes an insulative wafer device which is molded around the middle portions of the leads. The wafer device includes two substantially identical wafers that are each molded about the middle portions of leads whose rear portions extend in a single row. The two wafers have edges that are joined to produce a wafer device that is part of an assembly having multiple rows of contacts and two rows of lead rear portions.

Each lead front portion projects from the front face of a wafer, and each contact has a hollow rear portion that surrounds a lead front portion and which is joined thereto as by soldering. Each wafer has a forwardly projecting tower that closely surrounds the rear portion of each contact to mechanically hold the contact. The fact that the front portions of the leads are molded into the wafer at the same time that the towers are formed, assures precise concentricity of the front lead portions and towers.

The wafer device assembly is part of an insert that lies in a housing that is fixed to the circuit board assembly. The insert is allowed to "float" with respect to the circuit board assembly, by providing the insert with rearwardly projecting leaf springs whose free ends bear against opposite inside surfaces of the housing. The leaf springs tend to hold the insert centered in the housing, but allow the insert to shift sidewardly with respect to the housing without substantial stress on any parts of the system.

The novel features of the invention are set forth with particularity in the appended claims. The invention will be best understood from the following description when read in conjunction with the accompanying drawings.

DESCRIPTION OF THE PREFERRED EMBODIMENT

Figure 1:
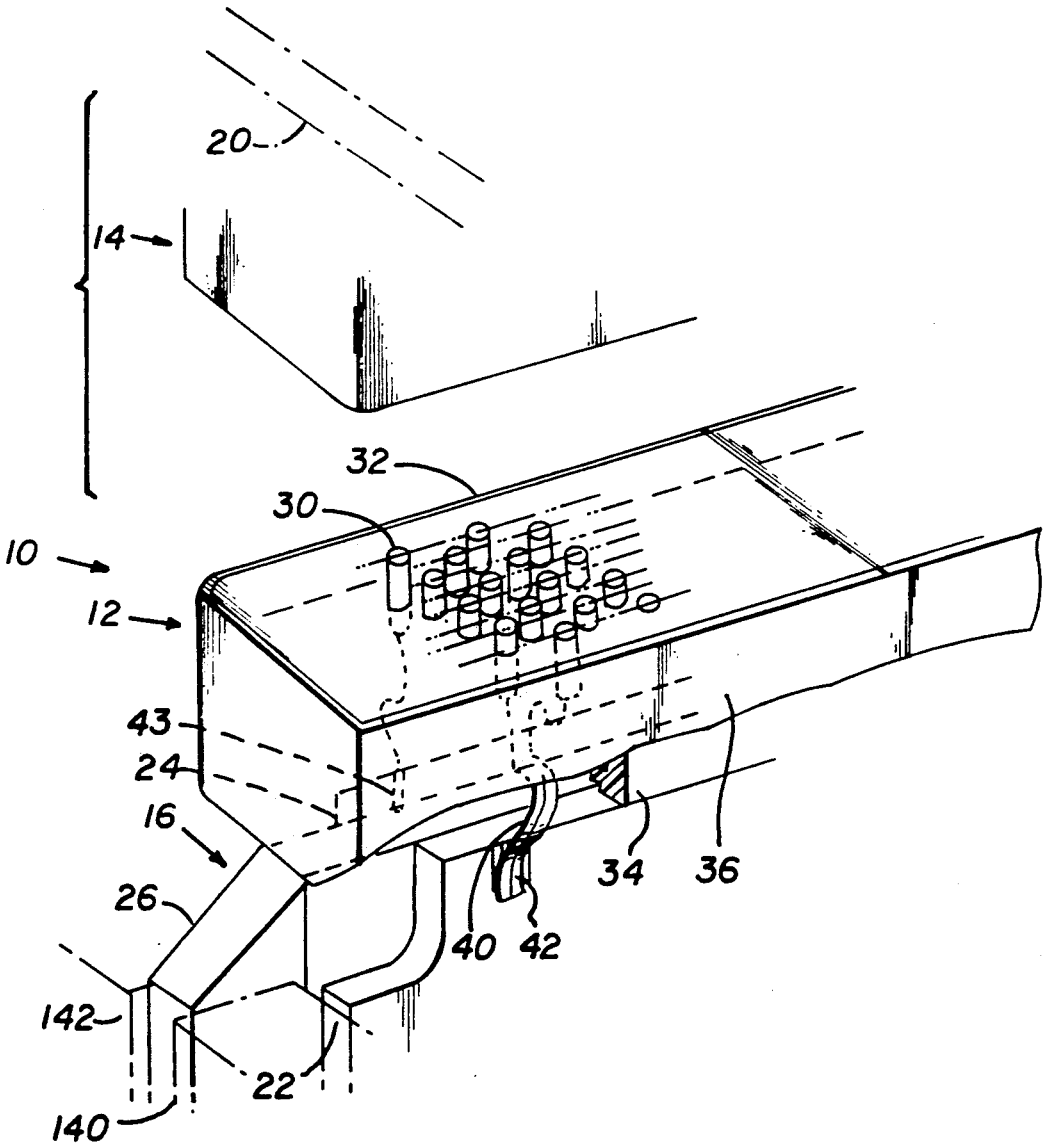
FIG. 1 is a partial exploded view of a connector system constructed in accordance with one embodiment of the present invention.
Figure 2:
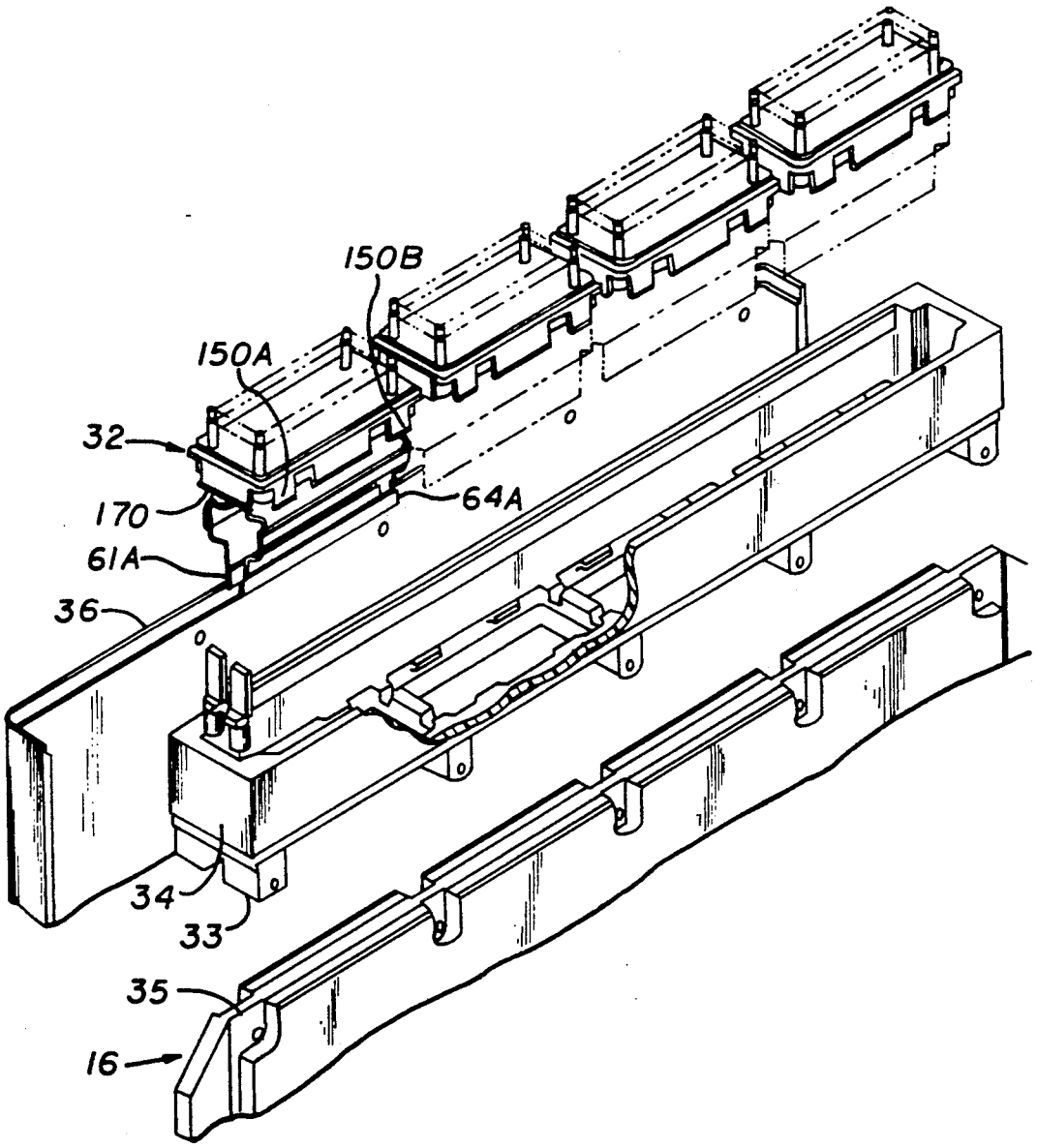
FIG. 2 is a more detailed exploded perspective view of a portion of the connector system of FIG. 1.

FIG. 1 illustrates a connector system 10 which includes two mateable connectors 12, 14 that can be mated to connect a circuit board assembly 16 to a mother board 20. The circuit assembly 16 includes two circuit boards 22, 24 joined facewise by a thermally-conducting adhesive to opposite faces of a plate-like heat sink 26. The connector 12 has a large number of contacts 30, socket contacts being shown, with the contacts arranged in multiple rows and columns to accommodate a large number of contacts in a connector of limited length. Complex equipment using this type of connector system usually requires more than 300 contacts in a length such as five inches. The contact assembly includes an insert 32 that lies within a housing 34 which is rigidly mounted to the heat sink 26 of the circuit board assembly. The mounting is accomplished through lugs 33 (FIG. 2) on the housing that straddle locations 35 on the heat sink and that are pinned to the heat sink. The assembly also includes a thin metal shell 36 around the housing. The insert includes a large number of leads 40 (FIG. 1) that have forward portions connected to the contacts 30 and rearward portions that engage terminals 42, 43 on the circuit boards 22, 24, with the terminals lying near an edge of each board.

Figure 3:
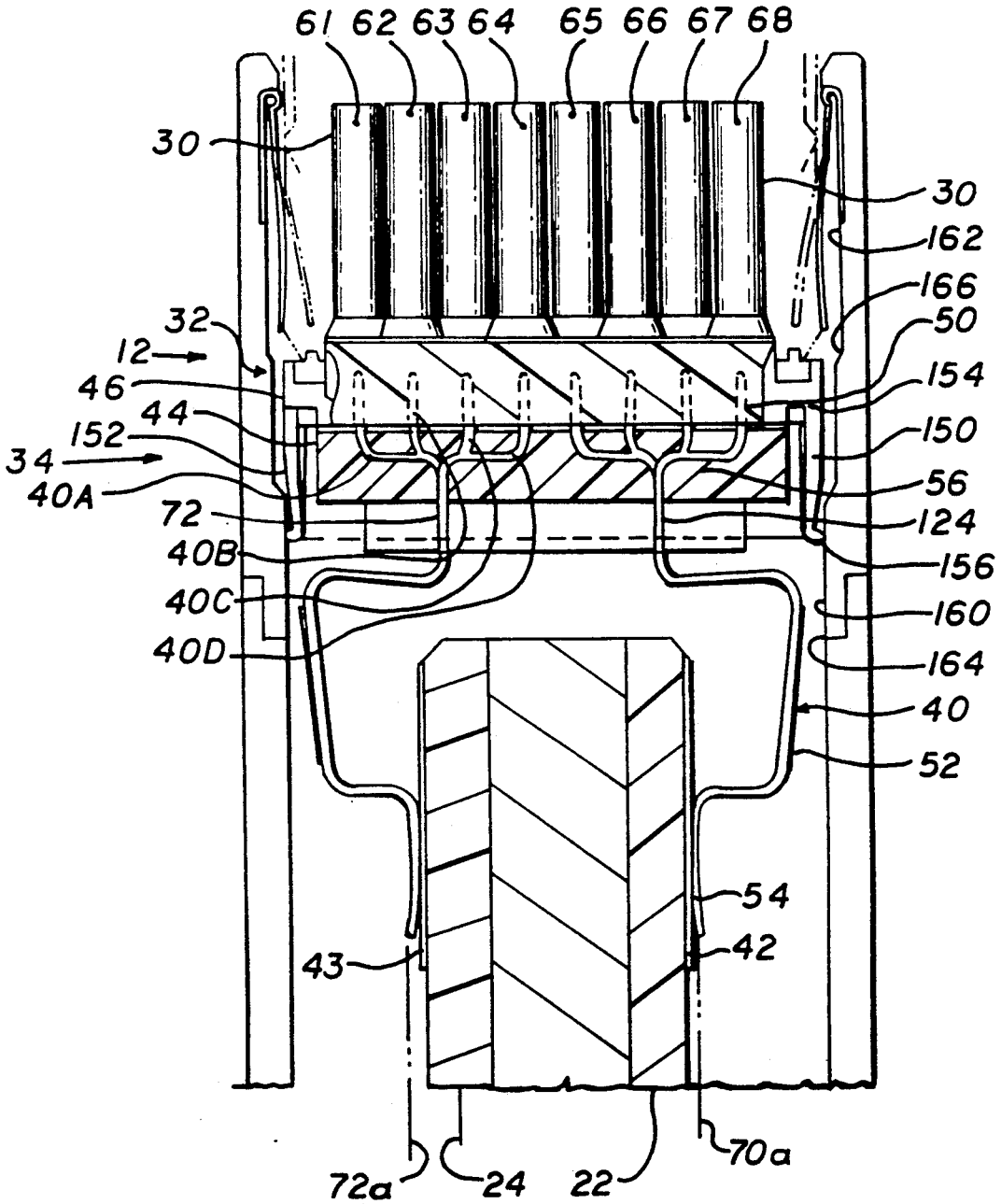
FIG. 3 is a partially sectional end view of the connector system of FIG. 2.

FIG. 3 illustrates some details of the connector 12. The insert 32 includes a wafer device 44 of insulative material and a forward insulator 46 lying on a forward face of the wafer device. Each lead 40 includes a forward portion 50 connected to a contact 30, a rearward portion 52 with a location 54 that engages a terminal 42 on a circuit board such as 22, and a middle portion 56 that lies within the wafer device 44. The middle portion 56 of each lead is molded into part of the wafer device 44.

For the particular connector shown, the contacts lie in eight rows as indicated by row lines 61–68. However, the rearward lead portions 52 lie in only two rows indicated at 70*a* and 72*a* to contact the two rows of terminals 42, 43 on the two circuit boards 22, 24. Accordingly, the middle portions 56 of different leads such as 40A–40D that connect to contacts in four different rows 61–64 are bent differently so as to extend the four leads to rear lead portions that all lie in the same row 72*a*. (It should be noted that the forward portions of leads 40A–40D do not all lie in the same column, as will be discussed below).

Figure 6:
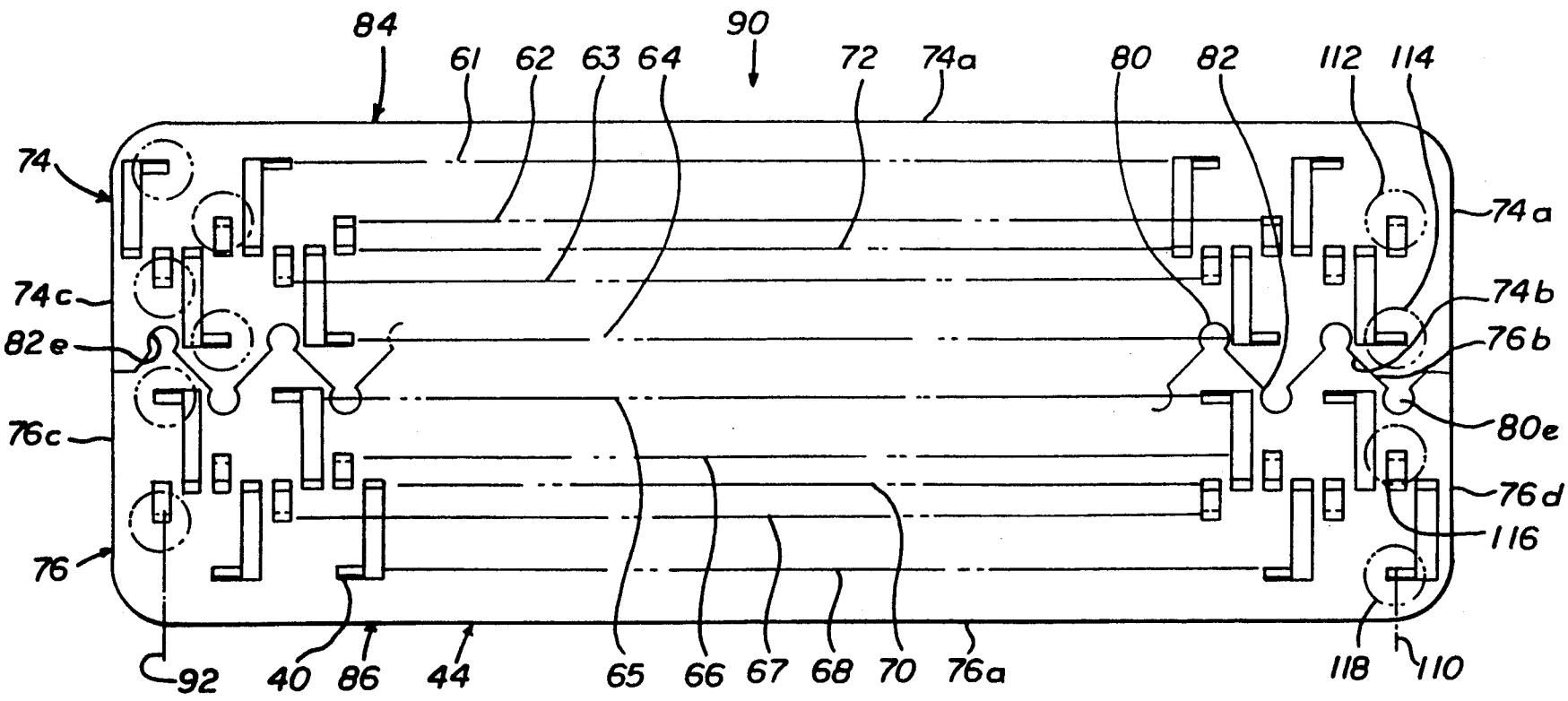
FIG. 6 is a plan view of the wafer device assembly of FIG. 4, but without the towers being shown, and with all portions of the leads being shown.

As shown in FIG. 6, the wafer device 44 is formed of two separate wafers 74, 76. Each wafer has a first or outer side 74*a*, 76*a*, and a second or inner side 74*b*, 76*b*, the wafers being joined together at their inner sides or edges. The inner edge of each wafer forms complimentary tongues 80 and grooves 82 between tongues. A first end such as 74*c* of a wafer has a groove 82*e* closest to its end, while the opposite end 74*d* of the wafer has a tongue 80*e* closest to its end. The two wafers 74, 76 are identical, and can be joined at their inner edges to form the wafer device 44. Each wafer such as 74 holds four rows of contacts at 61–64 and leads with rear portions lying along a single row 72. When the two wafers are joined, they provide eight rows of contacts and two rows of rear lead portions (at 72 and 70).

Each wafer such as 74 and the leads 40 molded therein form a wafer assembly, there being two wafer assemblies 84, 86. When joined together they form a wafer device assembly 90 which includes the wafer device 44 and all of the leads molded into it. Each wafer assembly such as 84 is formed separately from the other one 86, which makes manufacture of the apparatus much easier. During the molding of the wafer assembly such as 84, a large number of lead devices must be held in precise positions relative to the mold that forms the wafer 74. The mold traps the rear and front portions 52, 50 (FIG. 3) of each lead while a plastic material is injected into the mold to form the wafer. The fact that the mold has to position only a single row of leads, facilitates manufacture. If the mold had to accurately position two rows of leads, then the mold would have to be much more complex. By molding each wafer with a single row of leads (at least at their rearward portions) and thereafter coupling it to another similar wafer assembly with its own row of leads, applicant simplifies production. Furthermore, by making each of the two wafer assemblies identical, applicant only has to form a single design of wafer assembly, which further reduces cost.

Figure 7:
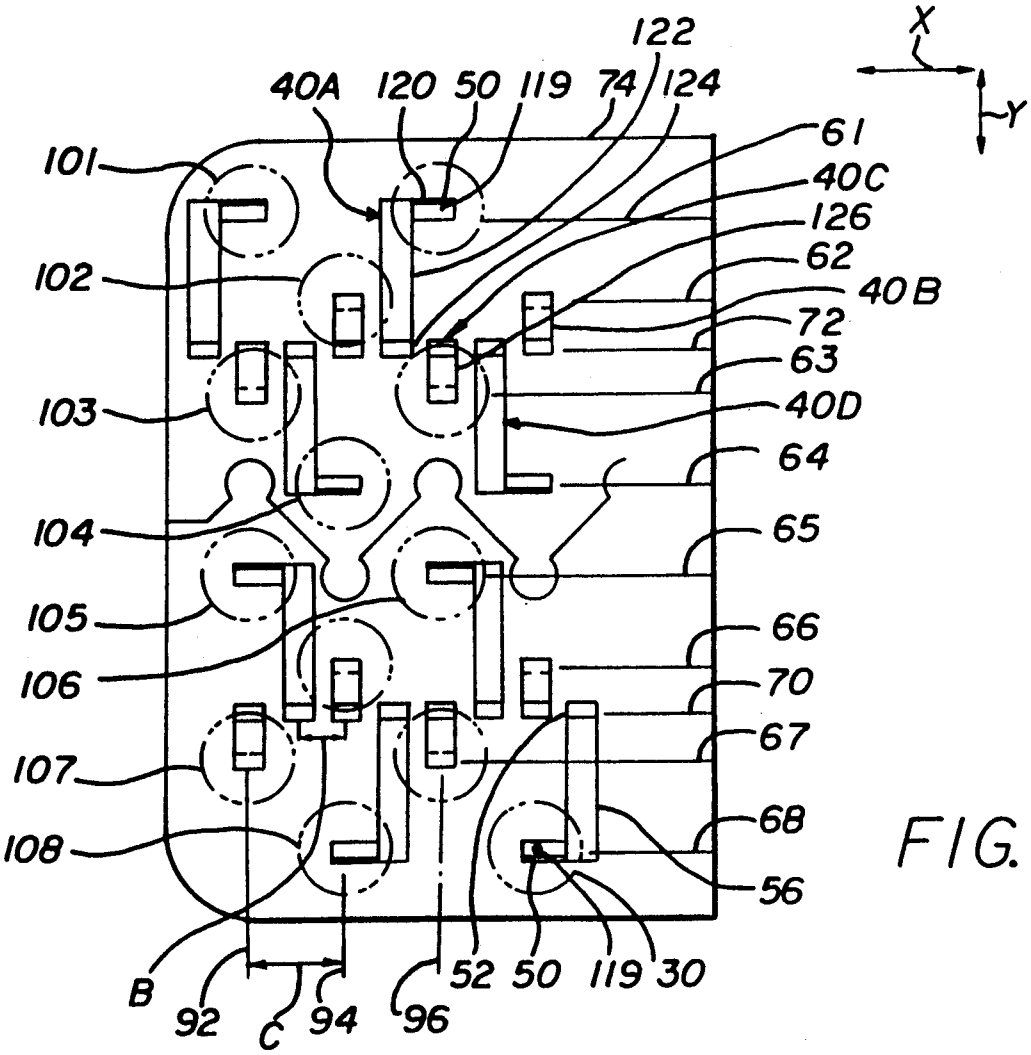
FIG. 7 is an enlarged view of an end portion of the wafer device assembly of FIG. 6.

As shown in FIG. 7, the contacts are located in columns such as 92, 94, 96, with each column having four contacts. The first column 92 has four contacts 101, 103, 105, and 107, while an adjacent second column 94 has four contacts 102, 104, 106, and 108. The rows of contacts are staggered, in that a second contact 102 lies on a row line 62 that extends between first and third contact rows 61, 63. Also, some contacts in the first and third rows 61, 63 lie in first and third columns 92, 96, while contacts in the second and fourth rows 62, 64 lie in a column 94 halfway between the first and third columns. It can be seen from FIG. 6, that the first column 92 which lies nearest the first end 74*c* of a wafer contains contacts in the first and third rows 61, 63 while a last column of contacts 110 on the same wafer contains contacts 112, 114 in the second and fourth rows 62, 64. This results in the two wafer assemblies 84, 86, oriented with one 86 turned 180° (about an axis extending in a forward-rearward direction) from the orientation of the other 84, creating a meshing pattern (i.e. the contacts 112, 114 combine with contacts 116, 118 on the other wafer to create a column of evenly spaced contacts).

Figure 4:
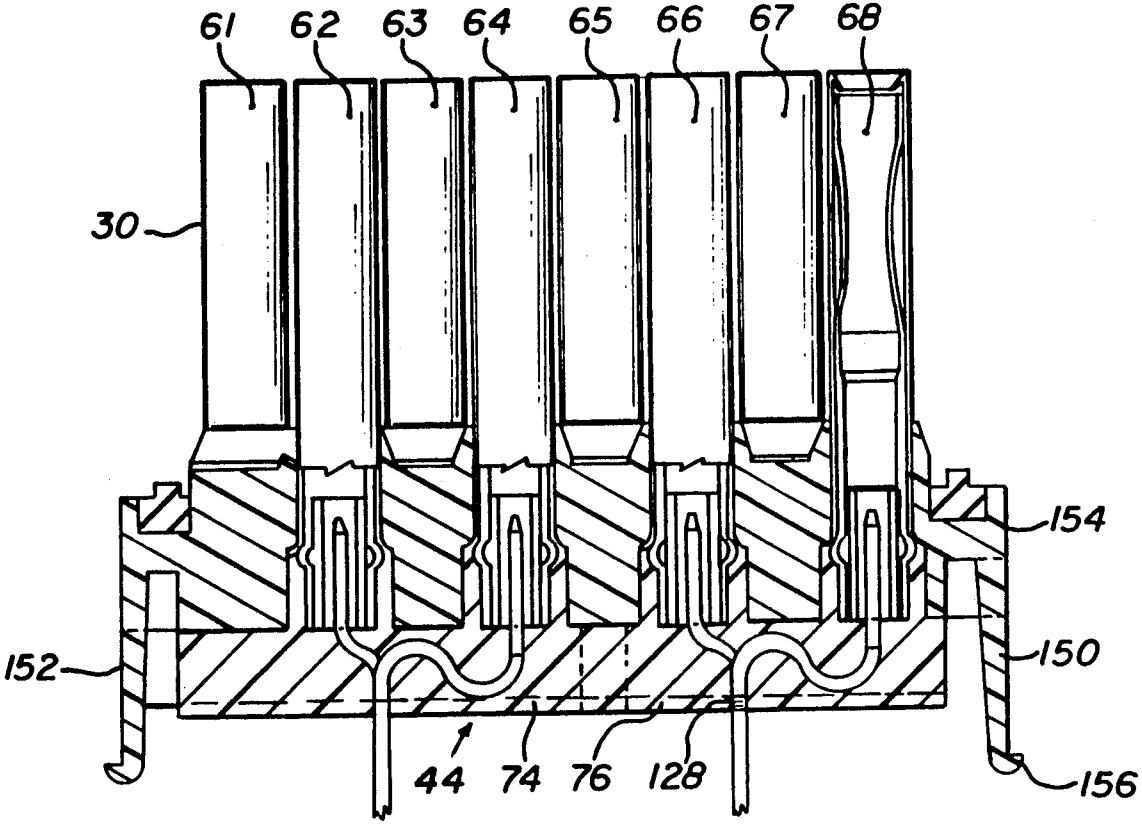
FIG. 4 is an enlarged view of a portion of the connector system of FIG. 3.

Referring to FIG. 7, it can be seen that the leads have four different configurations on each wafer. The lead middle portions 56 form transitions between the single row of rear lead portions 52 and the multiple row front lead portions 50. In a first lead configuration 40A, the lead includes a front portion 50 with an axis 119 lying concentric with a contact, a first middle portion 120 extending in a longitudinal direction x parallel to a row, and a second middle portion 122 extending in a longitudinal direction y parallel to a column. The rear end of the middle portion lies at 124 where it merges with the top of the rearward lead portion 52. A next lead 40C has a first middle portion 126 which extends only parallel to the column direction. Another lead 40D is a mirror image of the first one 40A, while a lead 40B is a mirror image of 40C. This arrangement results in the lead rear portions 52 lying in a row such as 70, at a spacing or pitch B which is one half the spacing or pitch C of the columns of contacts. It also may be noted that the rear of the middle lead portions (at 128 in FIG. 4) are bent to extend at an incline in the x direction, in order to align the rear lead portions of the two rows of leads.

Figure 5:
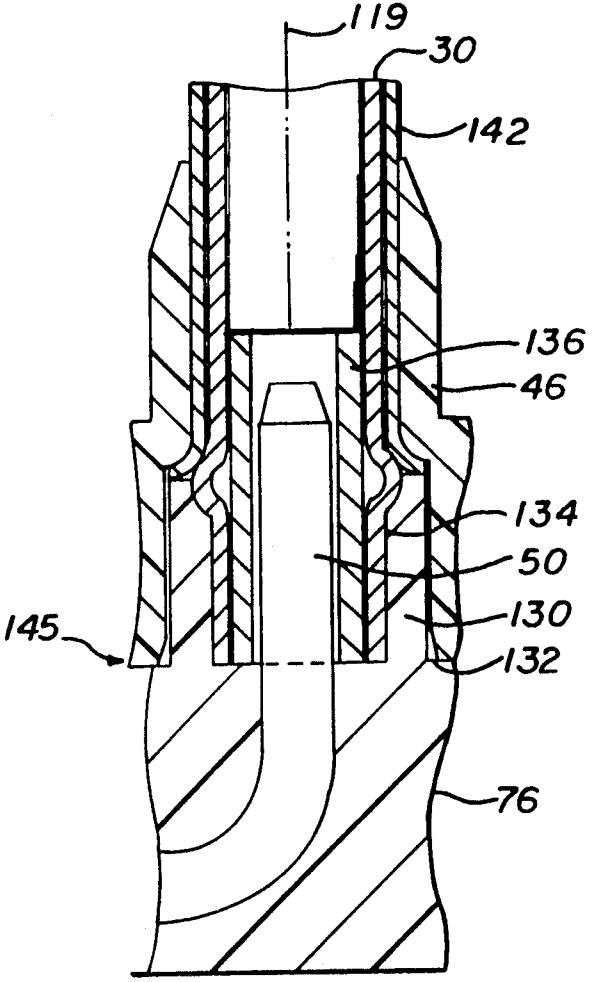
FIG. 5 is an enlarged view of a portion of the connector system of FIG. 4.

FIG. 5 illustrates the manner in which a contact 30 is connected to a lead front portion 50. The wafer 76 is molded to include a tower 130 which is in the form of a tube that projects forwardly from a front face 132 of the wafer. The tower 130 is of a size to closely surround a rearward portion 134 of the contact. The contact has a hollow rear portion that surrounds the lead forward portion 50. In the particular construction shown in FIG. 5, a sleeve 136 of solderable material is placed around the lead front portion 50 prior to inserting the contact 30 into the tower 130. After all contacts are inserted, the wafer device assembly is heated to melt the sleeve 136, so it flows onto the contact and lead front portion to electrically connect them. Other connection schemes can be resorted to, such as coating portions of the contacts and/or lead forward portions with solderable material or applying solder after the contacts are installed.

The axis 119 of the lead forward portion 50 and the axis of the tower 130, can be maintained precisely concentric, because the lead forward portion is held in the same mold which molds the tower. This assures that when the contact 30 is installed, it will fit into the space between the tower and lead forward portion, and around the sleeve 136. It may be noted that the contact 30 is often provided with a protective hood 142. The forward insulator 46 lies over the forward face of the wafer 76 and closely holds the hood 142. The forward insulator 46 and wafer device 44 together form an insulator assembly 145.

The connector is constructed by forming a first group of multiple leads whose contacts lie on row lines 61–64 (FIG. 4) on a carrier 61A (FIG. 2) attached to the rear ends of the leads, and a second group of leads whose contacts lie on row lines 64–68 on another carrier 64A, and deforming the middle portions of the leads. A row of leads is placed in a mold, with the front portions of the leads precisely held, and a plastic material is molded around the middle portions of the leads to form a wafer assembly. Then, the rear portions of the leads, which originally extended in straight lines in line with portion 124, are bent to the configuration shown in FIG. 3. The contacts are installed on the front faces of the wafer assembly. Two identical wafer assemblies are joined to form a wafer device assembly. The forward insulator 46 is then installed over the front face of the assembly on which the contacts have been installed, to form the insert 32. The insert is then installed in the connector housing 34. The carrier 61A, 64A can be cut away, and the rear lead portions are spread apart and slid onto the faces of the circuit board 22, 24 to contact the terminals 42, 43 on the circuit boards. The heat sink 26 (FIG. 1) of the circuit board assembly 16 may then be clamped as by clamp mechanism 140 against a heat dissipating apparatus 142.

During clamping of the heat sink 26, the circuit board assembly and the connector housing 34 may be sidewardly displaced by a small distance such as by 0.010 inch. If the insert, including the contacts, were also to be displaced by this amount, then there could be stresses in the housing, wafer, and contacts, if the mating connector resists sideward shifting. To avoid such high stresses, applicant mounts the insert in the manner shown in FIG. 3, where it can be seen that the insert 32 has a pair of centering springs 150, 152 at its opposite sides. The springs are of largely leaf spring construction, in that they include an elongated resiliently bendable member. The springs extend primarily in rearward and forward directions. Each centering spring has an inner end 154 mounted on and part of the insert insulator and a free outer end 156 that is biased against an inside surface 160 on the connector housing 34. The springs lie at opposite sides of the insert and tend to center the insert within the housing. However, if the insert is held against sideward movement as by a mating connector, the housing can move sidewardly relative to the insert by additional deflection of the one of the springs and release of some of the deflection of the opposite spring.

The housing walls include wide front portions 162 and narrower rearward portions 164 against which the spring free ends bear. The housing also has angled wall portions such as 166 which gradually compress the springs as the insert is inserted in a rearward direction into the housing. The connector also includes latches 170 (FIG. 2) that hold the insert in place, but allow the insert to be removed by inserting a special tool that deflects the latches toward each other to allow the insert to be pulled forwardly out of the housing. It can be seen in FIG. 2, that each insert 32 includes springs 150A, 150B near its opposite ends, and includes latches 170 at its opposite ends.

Figure 8:
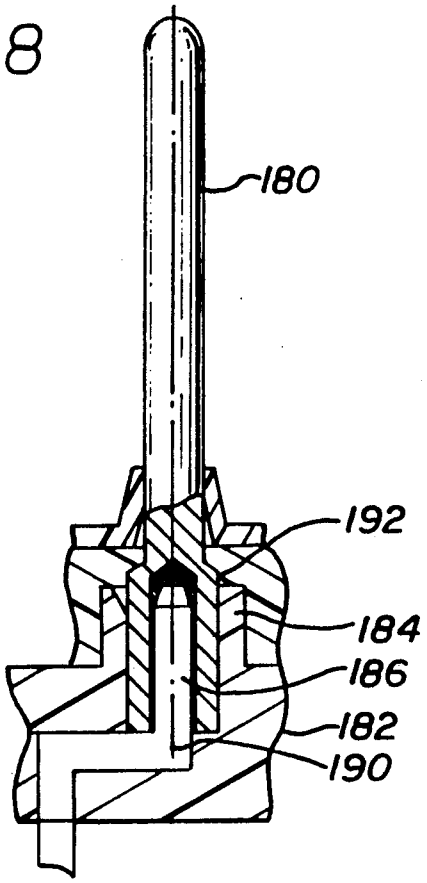
FIG. 8 is a sectional view of a portion of a wafer assembly constructed in accordance with another embodiment of the invention, showing a pin contact installed.

FIG. 8 illustrates another arrangement, wherein pin type contacts 180 are installed, instead of a socket type. The wafer 182 includes a tower 184 surrounding each lead front portion 186 and lying concentric with the axis 190 of the lead front portion. The contact has a hollow rearward portion 192 that is closely received within the tower 184 and which receives the lead front portion 186. The inside of the contact rear portion can be coated with solderably material which, when heated, joins to the lead front portion.

Thus, the invention provides a connector which has leads that connect multiple rows of contacts to two rows of terminals on a circuit board assembly, which can be constructed at relatively low cost. The connector includes an insert with a wafer device assembly that includes two substantially identical wafer assemblies. Each wafer assembly includes leads whose rearward portions extend in a single row, and whose forward portions lie in multiple rows to connect to contacts lying in multiple rows. The center portions of the leads are molded into a wafer which has a side or edge which can be joined to an identical wafer. Each wafer is molded with a forwardly projecting tower concentric with the axis of the forward portion of a lead, to precisely hold a hollow rear portion of a contact between them. Each insert includes elongated centering springs extending in a rearward direction, with free ends bearing against an inside wall of a housing, to center the insert within the housing but allow the housing to move sidewardly slightly without applying large stresses to parts of the connector.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector system comprising:

a circuit board assembly which includes a plate-like heat sink with opposite faces and a pair of circuit boards, said heat sink being sandwiched between said circuit boards, said boards each having an edge portion and a row of terminals spaced along its edge portion;

a connector housing rigidly attached to said circuit board assembly at said board edge portion and having walls with an inside surface;

at least one insert with opposite sides lying within said housing, said insert having an insulator assembly, a plurality of rows of contacts on said insulator assembly extending parallel to said opposite sides, and a plurality of leads, each lead having a front portion connected to a contact, a middle portion extending through said insulator assembly, and a rear portion projecting in a rearward direction from said insulator assembly, said lead rearward portions lying in two rows that engage said rows of terminals on said circuit boards;

a heat dissipating apparatus;

a clamp mechanism that clamps said heat sink against said heat dissipating apparatus to transfer out heat;

said insert having a plurality of centering springs, each spring comprising an elongated resiliently bendable cantilevered member extending primarily in a rearward direction and having an inner end mounted on said insert insulator assembly and a free outer end biased against an inside surface of said housing walls, said springs lying at opposite sides of said insert, whereby to allow said insert to float within said housing to avoid stresses when said heat sink is sidewardly displaced during clamping.

2. The connector system described in claim 1 wherein:

said housing walls have wide front portions, narrower rear portions, and angled wall portions extending between them, and said spring outer ends lie between said narrower rear portions.

3. A connector insert comprising;

a wafer device which includes a pair of substantially identical wafers constructed of insulative material, each having front and rear faces;

a plurality of leads that each has a front portion projecting from the front face of one of said wafers, a rear portion projecting from the rear face of the corresponding wafer, and a middle portion molded into the corresponding wafer;

a plurality of contacts lying at the front face of each wafer, each contact attached to said front portion of one of said leads;

said contacts lying in a first plurality of rows on each wafer, said wafers having adjacent edges extending primarily parallel to said rows and joined so the two wafers together hold twice the number of rows of contacts on each wafer;

each of said contacts has a hollow rearward portion which receives a said front lead portion, and each of said wafers includes a plurality of tower portions that each project from said front face and surround the rearward portion of a said contact and the forward portion of a said lead, whereby to enable precision locating of a said contact with respect to a said lead forward portion.

4. A connector system comprising:

a circuit board assembly having opposite board faces and a row of terminals on each of said board faces;

a wafer device of insulative material having front and rear faces;

a plurality of contacts arranged in at least four rows and a plurality of columns on said wafer device;

a plurality of leads that each has a forward portion projecting from said wafer device front face and coupled to one of said contacts, a rearward portion projecting from said rear face, and a middle portion molded into said wafer device;

said lead forward portions lying in said at least four rows, said lead rearward portions including locations lying in two lead rows and bearing against said opposite board faces against said terminals thereon, the pitch of said lead rows being smaller than the pitch of said columns;

at least some of said lead middle portions that are molded into said wafer device, each have parts extending in a longitudinal direction largely parallel to the length of said rows, and also in a lateral direction largely parallel to the length of said columns;

said wafer device includes two identical wafers that each have an inner edge, and said leads are arranged in identical wafer assemblies, said wafer assemblies being oriented with one turned 180° with respect to the other and the inner edges of the two wafers being joined.

* * * * *